US005240483A

United States Patent [19]

Rosen

[11] Patent Number: 5,240,483

[45] Date of Patent: Aug. 31, 1993

[54] REFRIGERANT FILTER-DRIER FOR USE IN A REFRIGERANT RECYCLING DEVICE

[75] Inventor: Shelvin Rosen, Pembroke Pines, Fla.

[73] Assignee: Mueller Refrigeration Products Co., Inc., Hartsville, Tenn.

[21] Appl. No.: 874,538

[22] Filed: Apr. 27, 1992

[51] Int. Cl.[5] ..... B01D 53/04

[52] U.S. Cl. ..... 55/270; 210/266; 210/282

[58] Field of Search ..... 55/270, 274, 316, 387, 55/389; 210/85, 266, 282, 284, 662, 739, 93

[56] References Cited

U.S. PATENT DOCUMENTS

| | | | |
|---|---|---|---|
| 1,412,790 | 4/1922 | Uehling . | |
| 2,225,990 | 12/1940 | Henry . | |
| 2,381,354 | 8/1945 | Larson . | |
| 2,628,484 | 2/1953 | Ayres et al. . | |
| 3,175,342 | 3/1965 | Balogh . | |
| 3,347,387 | 10/1967 | Balogh | 210/282 X |
| 3,680,707 | 8/1972 | Zeek | 210/266 |
| 3,834,130 | 9/1974 | Bissada et al. | 55/316 |
| 3,841,490 | 10/1974 | Hoffman et al. . | |
| 4,133,762 | 1/1979 | Visceglia et al. | 55/387 X |
| 4,234,425 | 11/1980 | Leo | 210/93 X |
| 4,584,001 | 4/1986 | Dechene | 55/387 X |
| 4,713,175 | 12/1987 | Bray | 210/282 X |
| 4,745,772 | 5/1988 | Ferris . | |
| 4,811,571 | 3/1989 | Mayer . | |

OTHER PUBLICATIONS

Catch-All ® Replaceable Core Filter-Drier Specifications, Bulletin 40-10, pp. 10-12 (no date).

*Primary Examiner*—Charles Hart

*Attorney, Agent, or Firm*—Harness, Dickey & Pierce

[57] ABSTRACT

A light-weight, readily replaceable filter-drier for use in a refrigerant recycling device comprising a long, narrow body containing a closely packed desiccant material that substantially occupies the entire volume of the body. The desiccant may be comprised of 100 percent molecular sieve or any combination of desiccants and/or other adsorbent materials that are required to achieve the desired degree of refrigerant purity. Filters are located at either end of the body which are biased by a spring member support and contain the desiccant material within the body. Standard fluid fittings close the ends of the filter-drier and enable the device to be easily and quickly installed and removed in the refrigerant recycling device. The present invention achieves the advantage of dramatically improving the efficiency and capacity of a filter-drier for use in a recycling device by substantially increasing the amount and duration of contact between the desiccant and the refrigerant. In a preferred configuration, multiple filter-driers are connected in series and have a moisture indicator located therebetween. Not only does a multiple filter-drier set-up increase total dehydration capacity and efficiency, but also it allows each individual filter-drier to be used to a greater capacity while still maintaining a factor of safety.

19 Claims, 2 Drawing Sheets

REFRIGERANT FILTER-DRIER FOR USE IN A REFRIGERANT RECYCLING DEVICE

BACKGROUND OF THE INVENTION

1. Field of the Invention

The present invention relates generally to a refrigerant filter-drier for removing moisture and other contaminating substances from a refrigerant and, more particularly, to a refrigerant filter-drier for use with a refrigerant recycling, recovery or reclamation device.

2. Discussion

It is well-known that refrigerants, especially chlorofluorocarbons (CFC's), used in vapor compression cooling systems (i.e., refrigeration systems) have a detrimental effect on the ozone layer of the earth's atmosphere when released from the refrigeration system into the environment. To this end, Federal legislation has been exacted, commonly referred to as the Clean Air Act, that has mandated strict requirements directed toward eliminating the release of CFC's into the atmosphere. In fact, after Jul. 1, 1992 it will be a violation of Federal Law to vent any CFC's to the atmosphere and stiff fines and penalties will be levied against violators.

Consequently, the need for effective refrigerant recycling, recovery and reclamation equipment (hereinafter referred to as "recycling equipment") has developed. A natural spin-off from the refrigeration and heating, ventilating and air-conditioning (HVAC) industries, the technology for the new field of recycling equipment has evolved from existing ideas, techniques and equipment known in the refrigeration and HVAC fields. In general terms, recycling equipment collects and reuses the refrigerant of a refrigeration system that has broken down and is need of repair or one that simply requires routine maintenance involving the removal of refrigerant. However, it should be noted that the terms "recover," "recycle" and "reclaim" have significantly distinct definitions in the art and that each definition connotes specific performance characteristics of a particular piece of recycling equipment.

"Recover" means removing refrigerant, in any condition, from a system and storing it in an external container without necessarily testing or processing it in any way. "Recycle" means to clean recovered refrigerant for reuse by separating oil and making a single or multiple passes through devices, such as replaceable core filter-driers, which reduce moisture, acidity and particulate matter that have contaminated the refrigerant. Finally, "reclaim" means to reprocess the recovered and/or recycled refrigerants to new product specifications by means which may include distillation. Chemical analysis of the refrigerant is typically required to determine that appropriate product specifications are met. Thus, the term "reclaim" usually implies the use of processes or procedures available only at a reprocessing or manufacturing facility.

Pursuant to the Clean Air Act, the Environmental Protection Agency (EPA) is charged with promulgating and enforcing regulations which require that recycling equipment be certified for a particular task (i.e., recycle, recover or reclaim). Failure to use certified recycle equipment can result in heavy fines to the violators.

Furthermore, the Air-Conditioning And Refrigeration Institute (ARI) has promulgated standards to define a level of quality for new and reclaimed refrigerants which can be used in new or existing refrigeration and air-conditioning equipment. The standard is intended to provide guidance to the industry, including manufacturers, refrigerant reclaimers, and the like.

It is also well-known in the refrigeration and HVAC fields that contaminated refrigerant can result in the failure of refrigeration system components such as the compressor. Moisture or water vapor of any kind in the refrigerant is a common contaminant. Therefore, removal of moisture and other contaminants from the refrigerant is necessary for the continued efficient operation of the refrigeration system. Thus, it is virtually mandatory for recycling equipment to employ a filter-drier device to clean and dry the refrigerant that is recovered from the system being serviced before the refrigerant is reused. As already mentioned, the term "recycle" requires that recovered refrigerant make a single or multiple passes through devices which reduce moisture.

A filter-drier device most commonly used with recycling equipment includes a replaceable drier block or core that is molded from a desiccant material or a blend of different desiccant materials which, in some instances, include another type of adsorbent material such as activated charcoal. This type of filter-drier is referred to as a "replaceable core filter-drier." The core is tubular in shape and has a longitudinal passageway running through its length to provide for the uniform flow of refrigerant through the filter-drier device. A typical replaceable core filter-drier device 10 currently in use is illustrated in FIG. 1. Replaceable core filter-driers were designed for and have long been used in standard refrigeration equipment in the Refrigeration and HVAC industries. Such driers were attempted to be adapted for a new application in recycling equipment. However, as will be further described, this type of filter-drier was not designed to operate as part of a refrigerant recycling, recovery o reclamation device and is, therefore, not efficient when used with such equipment.

A replaceable core filter-drier is designed to perform as a permanent part of the refrigeration circuit. As shown in FIG. 1, the replaceable core filter-drier 10 includes a heavy, cast steel housing 12 that is closed by a steel plate 14 with a plurality of ⅜ or ½ inch diameter bolts 16. The overall length of the filter can vary between 9 and 35 inches. One or more replaceable drier cores 18, weighing approximately 1.5 pounds each, are disposed within the housing 12. Conventional replaceable core filter-drier devices 10 weigh between 12 and 25 pounds, and in some models the filter-drier weighs as much as 50 pounds. The flow of refrigerant through the filter-drier device 10 is indicated by arrows A. When the effective moisture removal capacity of the drier core(s) 18 is exhausted, the entire filter-drier device 10 must be disassembled and the core(s) 18 replaced.

With particular reference to the drier core 18, the flow of refrigerant through the drier core 18 when the filter-drier 10 is installed in a refrigeration circuit is indicated by the arrows B. As indicated by the thickness T of the drier core 10, the refrigerant comes into contact with only a small portion of the desiccant and, therefore only a small portion of the desiccant is utilized to dry the refrigerant on each pass of the refrigerant through the filter-drier device 10. In fact, the thickness T of the desiccant to which the refrigerant is exposed on each pass through the refrigeration circuit may be as little as 1 inch. Consequently, the refrigerant must make numerous passes through the filter-drier device 10 in order to provide contact with a sufficient amount of the desiccant in the drier core 18 and thereby achieve purification to an acceptable level.

Although the replaceable core filter-drier 10 has proved successful in purifying and maintaining the purity of refigerant when it has been installed in the refrigeration circuit of a refrigeration system, it requires a continuous flow of refrigerant therethrough during the system operation to establish and maintain such purity.

A filter-drier for use in recycling equipment, however, must be capable of removing the moisture and other contaminants from the refrigeration circuit being serviced quickly and efficiently and is desired to be light-weight as well. An obvious disadvantage of the conventional replaceable core filter-driers is that they are heavy, bulky and the drier cores are difficult to replace. Another disadvantage of such filter-driers is that they require a continual circulation of the refrigerant in order to reduce the contaminant level in the refrigerant to an acceptable level. In many cases, a service operator may complete the maintenance or repair on the refrigeration system and then be required to wait hours, possibly even days, before the refrigerant is purified to an acceptable level. Therefore, considering the fact that the labor involved in servicing a refrigeration system is a substantial component of the cost of performing the service, it is extremely important that the time required by the service operator to purify the refrigerant be kept at a minimum. In addition, there is a conspicuous waste of energy if the recycling equipment is required to run for hours or days in order to adequately dry the refrigerant to the required level. Further, it is doubtful that recycling equipment utilizing a conventional replaceable core filter-drier could reduce the moisture level in particular refrigerants with high moisture solubility such as R22, R502, R123 or R134*a*, to meet the ARI Standard 700 specification according to the ARI Standard 740 test procedure. (As yet, R123 and R134*a* refrigerants have not been included in ARI Standard 700, however their future inclusion is anticipated). It is also doubtful that recycling equipment using the replaceable core filter-drier could reduce the moisture level of R134*a* to an acceptable level per SAE Standard J2099 when tested under SAE Standard J2210.

Accordingly, it is clear that replaceable core filter-driers are not adequate for drying refrigerant as part of a refrigerant recycling device. In an attempt to address this deficiency, filter-driers employing a loose-fill desiccant have been used, however, very limited success has been achieved. Thus, it is clear that no currently available filter-drier device adequately satisfies the dehydration efficiency requirements for use in a refrigerant recycling device It is therefore an object of the present invention to provide filter-drier for use in a refrigerant recycling device that is significantly more efficient than filter-driers presently in use with recycling equipment by substantially increasing the amount of desiccant coming into contact with the refrigerant on each pass of the refrigerant through the filter-drier as well as the duration of such contact.

It is another object of the present invention to provide a filter-drier for use in a refrigerant recycling device that is light-weight and readily replaceable.

It is another object of the present invention to provide a filter-drier for use in a refrigerant recycling device that, in all applications, substantially reduces the number of passes of the refrigerant through the filter-drier that are required to achieve the desired purity of refrigerant and, in most applications, requires only a single pass.

It is a further object of the present invention to provide a filter-drier for use in a refrigerant recycling device that will adequately dry high moisture solubility refrigerants, such as R22, R502, R123 and R134*a* to ARI Standard 700 specifications according to the ARI Standard 740 test procedure.

It is a still further object of the present invention to provide a filter-drier for use in a refrigerant recycling device that is able, in a single pass, to dry R12 refrigerant in automotive A/C applications to SAE Standard J1991 when tested per SAE Standard J1989.

Also it is an object of the present invention to provide a filter-drier for use in a refrigerant recycling device that is able, in a single pass, to dry R134*a* refrigerant in automotive A/C applications to SAE Standard J2099 when tested per SAE Standard J2210.

SUMMARY OF THE INVENTION

Accordingly, the present invention is directed to a light-weight, readily replaceable filter-drier for use in a refrigerant recycling device comprising a long, narrow cylinder or body containing a closely packed desiccant material that substantially occupies the entire volume of the body. The desiccant may be comprised of 100 percent molecular sieve or any combination of desiccants and/or other adsorbent materials that are required to achieve the desired degree of refrigerant purity. Filter members which are located at each end of the body and are biased by a spring member support and contain the desiccant material within the body. Standard fluid fittings close the ends of the filter-drier and enable the device to be easily and quickly installed and removed in the refrigerant recycling device. An individual filter-drier of the present invention may weigh as little as 2.25 pounds or less. Preferably, multiple filter-driers of the present invention are connected in series and have a moisture indicator located therebetween. Not only does such a multiple filter-drier set-up increase total dehydration capacity, but also it allows each individual filter-drier to be used to a greater capacity while still maintaining an adequate factor of safety.

The present invention significantly increases the length of the desiccant material through which the refrigerant must pass and, therefore, increases the quantity and duration of exposure of the refrigerant to the desiccant as the refrigerant advances through the filter-drier. In doing so, the present invention is able to, in many cases, dry and purify a variety of high moisture solubility refrigerants, including R22, R502, R123 and R134*a*, according to ARI Standards in a single pass. It is also believed that the present invention is capable of drying R134*a* refrigerant from a single automotive A/C to SAE Standards in a single pass.

A significant advantage of the present invention is that it dramatically increases the efficiency of a filter-drier for use in a recycling device by substantially increasing the amount and duration of contact between the desiccant and the refrigerant. The significant increase in efficiency of the filter-drier results in the saving of time, energy and other costs, such as labor, associated with refrigeration system maintenance and repair. For example, in essentially all cases, the present invention will allow the recycling equipment to complete the processing and purification of the refrigerant and have it ready to return to the refrigeration system by the time the service operator has completed the maintenance or repair of the refrigeration system being serviced.

Another advantage of the present invention is that it may be used to dry a variety of high moisture solubility refrigerants, such as R22 or R134*a*, to ARI 700 and SAE Standards, respectively.

Yet another advantage of the present invention is that in the preferred embodiment, multiple filter-driers can be connected in series to increase the dehydration capacity of the unit over a single filter-drier of the present invention and allow each filter-drier to be used to maximum capacity while still maintaining a factor of safety.

Still other advantages of the present invention are that it is light-weight, it is easy and inexpensive to manufacture, it can be tailored to meet specific recycling needs, and it can be easily replaced as an entire unit or as a component of a multi-unit configuration.

Other advantages of the present invention will become apparent to one skilled in the art as the invention becomes better understood upon reference to the following detailed description in view of the accompanying drawings.

BRIEF DESCRIPTION OF THE DRAWINGS

Specific embodiments representing what is presently regarded as the best modes of carrying out the present invention are illustrated in the accompanying drawings in which.

DESCRIPTION OF THE PREFERRED EMBODIMENTS

It should be understood from the outset that while the following discussion relates to particular embodiments of the present invention, these embodiments merely represent the best modes of currently practicing the invention and other modifications may be made to the particular embodiments without departing from the spirit and scope of the invention.

Figure 1:
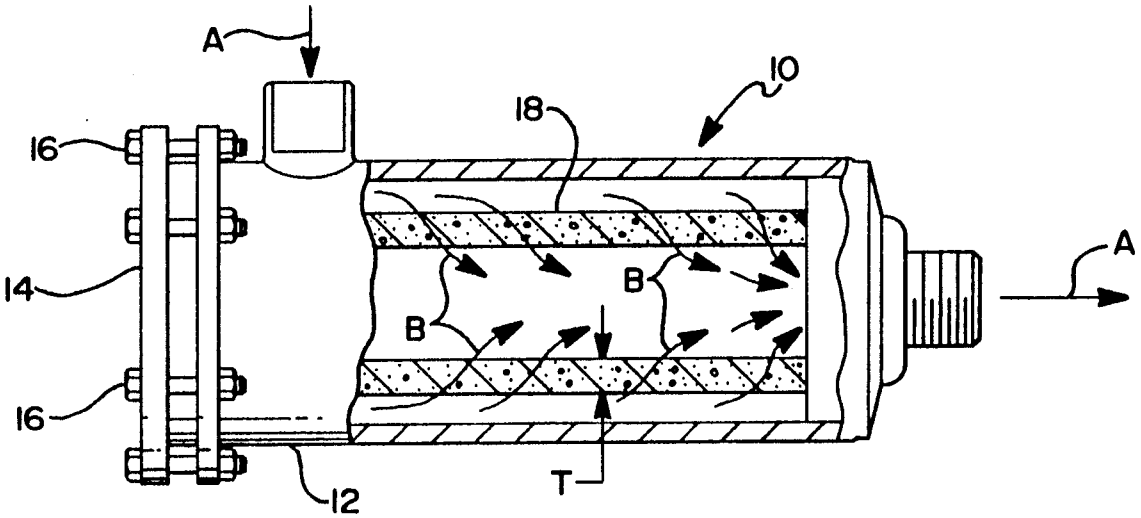
FIG 1 PRIOR ART
FIG. 1 is a transverse partial cross-sectional view a prior art filter-drier device having a replaceable core drier.
Figure 2:
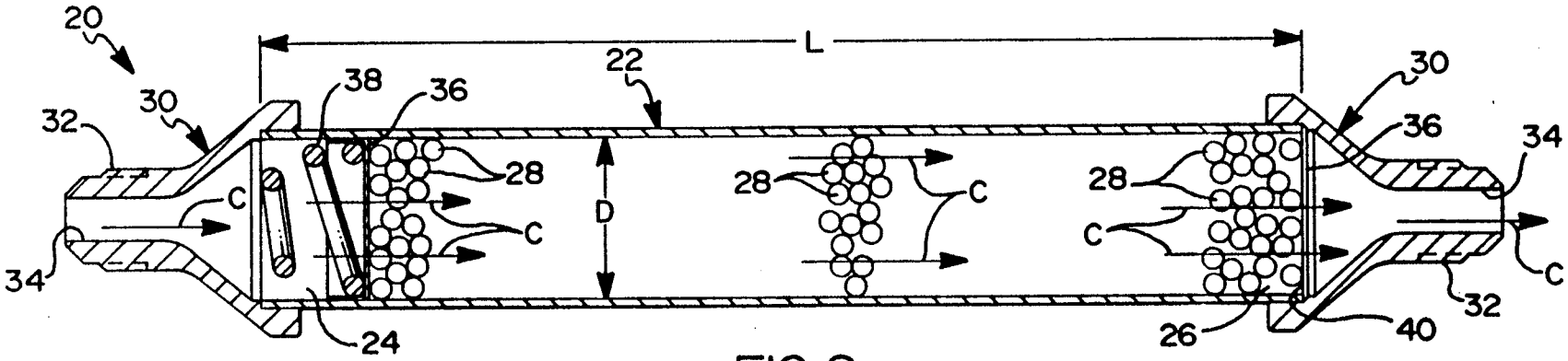
FIG. 2 is a transverse cross-sectional view of the filter-drier of the present invention.

Referring to FIG. 2, the filter-drier 20 of the present invention is shown to include a long, narrow cylinder or body 22 having an inlet end 24 and an outlet end 26. The body 22 contains a closely-packed beaded desiccant material 28 that occupies substantially its entire volume. Standard fluid fittings 30 close the ends 24, 26 of the body 22 and may be secured by soldering, brazing, or any suitable joining or fastening means. The fluid fittings 30 also provide common connections 32 which enable the present invention 20 to be easily and quickly installed and removed in the refrigerant recycling device (not shown). Passageways 34 through the fluid fittings 30 facilitate the flow of refrigerant through the filter-drier 20. A filter 36 is located at both the inlet end 24 and the outlet end 26 of the body 22. A spring member 38, located at the inlet end 24 of the body 22, biases the inlet filter 36 snugly against the desiccant material 28, which is, in turn, biased against the outlet filter 36. The spring member 38 supports and maintains the desiccant material 28 in a closely-packed relationship. Also located at the outlet end 26 of the body 22 is a mesh screen 40 which operates to trap particulate matter.

The basic structure of a body, filters, screens, a spring and fluid fittings of one type or another is well-known in the art and meets all applicable engineering specifications for pressure vessels. Variations of this common structure will not significantly effect the operation of the present invention, if at all, and therefore the present invention is not intended to be limited to such recited structure.

With reference once again to FIG. 2, the body 22 has a length L preferably about 24 inches, however, it may range from about 15 inches to as much as 36 inches or more. The body's 22 inner diameter D can range from about 1 inch to 2 inches; however, it may be larger provided that uniform flow of the refrigerant through the desiccant is not inhibited, such as by channeling.

The desiccant material 28 can be molecular sieve, activated alumina, silica gel or any combination of desiccants and/or other adsorbent materials, such as activated charcoal, that are necessary to achieve the desired level of purification of the refrigerant in the system being serviced. However, 100 percent molecular sieve is generally preferred. In any case, the desiccant 28 is closely packed and does not lose dehydration capacity (unlike the molded core driers 18 which may lose as much as twenty-five percent of their dehydration capacity due to the chemical and physical reactions which take place during the bonding of the core). It should be understood that the desiccant content of the filter-drier 20 may also vary according to the particular needs of certain recycling situations. For example, if additional organic acid capacity is desired, the filter-drier body can be filled with a desiccant mixture of activated alumina and molecular sieve.

Based upon the preferred dimensions L, D of the filter-drier 20 of the present invention already provided and illustrated in FIG. 2, it can be determined that a filter-drier 20 having a 24 inch long body with a 1 inch inner diameter will hold about 0.7 pounds of molecular sieve, the preferred desiccant 28. Again based upon the preferred dimensions L, D, the entire filter-drier 20 weighs as little as 2.25 pounds, approximately one-sixth to one-tenth the weight of many filter-driers 10 currently used with recycling equipment.

In operation in a recycling device, the filter-drier 20 of the present invention is disposed vertically, with the inlet end 24 positioned beneath the outlet end 26 (i.e. such that the flow through the filter-drier 20, as indicated by arrows C, is directed in the upward direction). Although the filter-drier 20 may also be disposed horizontally or diagonally, it is believed the most optimum contact between the refrigerant and the desiccant 28 is achieved when the filter-drier 20 is oriented vertically. The standard fluid fittings 30 facilitate connection of the filter-drier 20 to the recycling device. Liquid refrigerant is delivered to the inlet end 24 of the filter-drier 20 and flows upwardly through the desiccant 28. As the refrigerant moves upwardly through the body 22, the desiccant 28 reacts with the moisture in the liquid refrigerant in such a manner that the moisture is adsorbed by the desiccant 28.

The filter-drier 20 of the present invention is intended to be used and then replaced when its useful life has elapsed. Its useful life may be determined by the indication of a moisture indicator, the passage of a select amount of refrigerant through the filter-drier 20 or other suitable means. For example, it can be calculated, based upon the amount of desiccant 28 in the body 22, that the filter-drier 20 can adsorb a certain quantity of moisture. Further, the amount of moisture in a particular refrigerant at saturation (i.e. its maximum moisture content) is known. Therefore, based upon the amount of the refrigerant which has passed through the filter-drier 20, the maximum amount of moisture which could have been passed through the filter-drier 20 can be calculated. Thus, knowing the moisture capacity of the filter-drier 20 as well as the maximum amount of moisture in the refrigerant, a quantity of refrigerant whose maximum moisture content is less than or equal to the capacity of the filter-drier 20 may be predetermined, with a factor of safety as desired. Consequently, a recycling device starting with a new filter-drier 20 could be used on a number of service occasions to dehydrate the refrigerant of a number of refrigeration systems. When the predetermined amount of refrigerant has passed through the filter-drier 20 it is simply removed and replaced. This removeability feature is unlike that of replaceable core filter-driers 10, which require that the filter-drier 10 be disassembled in order to replace the drier core 18.

It is important to appreciate that because the present invention 20 is significantly greater in length L (yet lighter) than conventional filter-driers 10 and, further, because the present invention 20 utilizes a beaded desiccant 2 occupying substantially the entire volume of the body 22, the refrigerant contacts a substantially greater amount of desiccant 28 on any pass through the filter-drier 20 as compared to the molded desiccant core 18. Every molecule of fluid passing through the filter-drier of the present invention must pass through 24 inches of desiccant whereas the length of desiccant refrigerant must pass through in current filter-driers may be as little as 1 to 1.25 inches. It is this combination that results in the significant increase in the dehydrating efficiency of the present invention over any currently used filter-drier 10.

Figure 3:
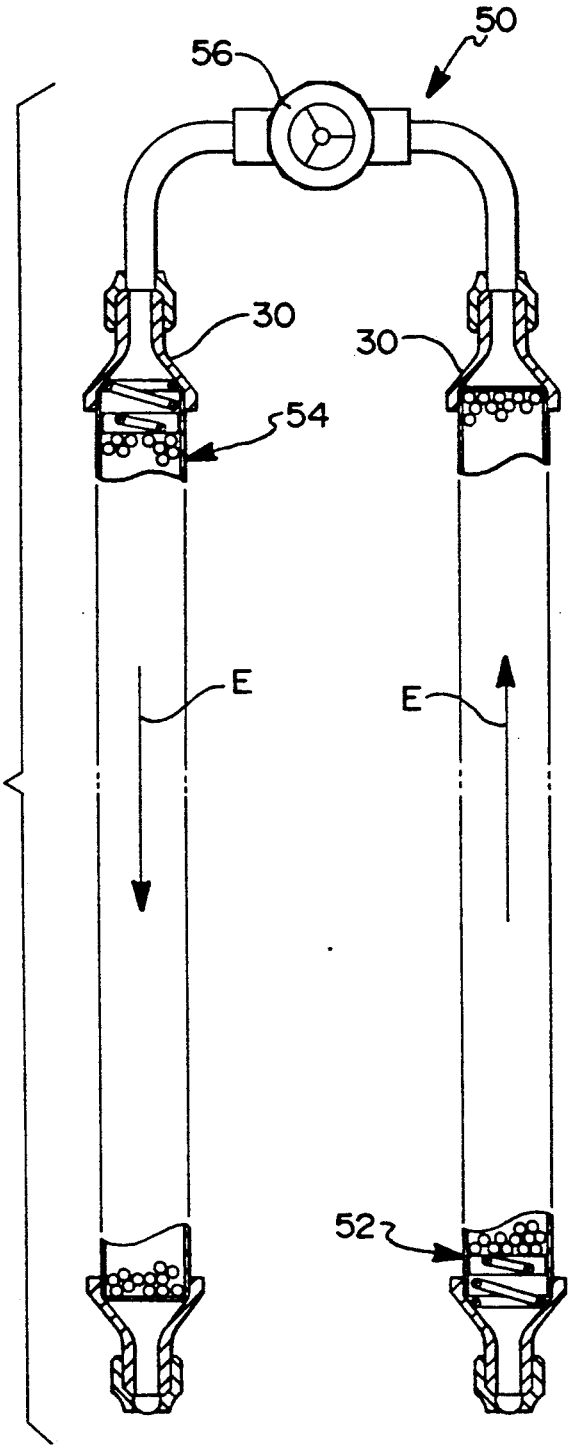
FIG. 3 is a plan view, partially in cross-section, of an alternate embodiment of the filter-drier of the present invention having two filter driers connected in series and including a moisture indicator located therebetween.

Turning now to FIG. 3, an alternate and preferred configuration 50 of multiple filter-driers 2 of the preferred dimensions as set forth above is illustrated. In this embodiment 50, a first filter-drier 52 is connected to a second filter-drier 54 in series, effectively doubling the drying capacity and significantly increasing the efficiency of the individual filter-drier 20 described above. A moisture indicator 56 is connected via the standard fluid fittings 30 of each filter-drier 52, 54 to provide an indication when the first filter-drier 52 should be replaced. Refrigerant flow through the unit is indicated by arrows E and may be described as follows: refrigerant enters into and passes through the first filter-drier 52; the refrigerant then exits the first filter-drier 52 and passes through the moisture indicator 56; next, the refrigerant exits the moisture indicator 56 and flows through the second filter-drier 54.

It should be noted that moisture indicators, which are well-known in the art, are not capable of indicating moisture content levels in refrigerants as low as are required to meet the ARI Standard 700 specification (i.e., 10 ppm water). Further, moisture indicators cannot instantaneously indicate the moisture content level of the refrigerant flowing through them. In fact, moisture indicators generally have a "lag time" and, therefore, indicate moisture content levels of the refrigerant that are drier (i.e., lower) than the actual moisture content level of the refrigerant.

As described earlier, it is contemplated that each filter-drier 52, 54 of the present invention will be replaced when it has elapsed its useful life. A particular advantage of the multiple filter-drier configuration 50 is that each filter-drier 52, 54 may be utilized to a greater capacity than would be capable if used individually and yet still provide an adequate factor of safety. To illustrate, consider the dual filter-drier configuration 50 described above. As the refrigerant to be recycled moves through the device 50, moisture is removed from the refrigerant in the first filter-drier 52. The refrigerant then reaches the moisture indicator 56 which indicates the moisture content level of the refrigerant. Even though the moisture indicator 56 will indicate that the refrigerant that is leaving the first filter-drier 52 is dry when it is actually wet (due to the inherent lag time of the moisture indicator 56), the present dual filter-drier configuration 50 will be capable of dehydrating the refrigerant because there is a second filter-drier 54 connected in series. Further, once the moisture indicator 56 overcomes the lag time and indicates that the first filter-drier 52 should be replaced (by now indicating that the refrigerant passing through the moisture indicator 56 has a moisture level which is in excess of the desired level, typically the ARI Standard 700 level of 10 ppm water), the second filter-drier 54 has still maintained a majority of its dehydrating capacity and is easily capable of completing the drying of the refrigerant passing through it. At this point, the first filter-drier 52 is removed and the second filter-drier 54 is moved to the first filter-drier location. A new filter-drier is then added to the dual filter-drier configuration in the second filter-drier location. This process is then repeated as necessary.

Of course, more than two filter-driers 20 can be connected in series with one another, in a like manner as described above, if desired. However, it is readily apparent that only a single moisture indicator 56 located between the first and second filter-driers is required. As each first filter-drier is removed, each subsequent filter-drier is simply moved to the next forward location.

It should also be appreciated that each filter-drier 20 connected in series can contain either similar or dissimilar desiccants 28, as described above. For example, a filter-drier 20 containing a desiccant 28 of activated alumina can be connected in series with a filter-drier 20 containing a desiccant 28 of molecular sieve.

Figure 4:
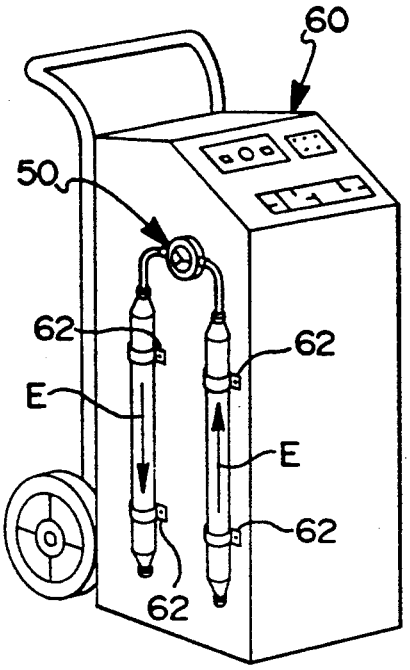
FIG. 4 is a perspective view of the filter-drier of FIG. 3 shown as part of a refrigerant recycling device.

The filter-driers 20, 50 of the present invention are intended for use as part of a recycling device 60 and can be easily mounted thereon for use in recycling recovered refrigerant as is illustrated in FIG. 4. Any standard clamps 62, or the like, may be easily employed to mount the filter-driers 20, 50 to the recycling device 60.

A dual filter-drier configuration 50 of the present invention which employed two individual filter-driers each having a body 22 with a length L of twenty-four inches (24") and an inner diameter D of one inch (1") has been tested in a refrigerant recycling device. The test was conducted with a high moisture solubility refrigerant, namely R22, and according to the ARI Standard 740 specification for testing and evaluating recycle equipment. According to ARI Standard 740 specification for R22 refrigerant, the test must utilize refrigerant having a wet moisture content level of at least 200 ppm water. The dual filter-drier configuration 50 of the present invention was used in a refrigerant recycling device that was tested with 50 pounds of R22 refrigerant beginning at a wet moisture content level of 208 ppm water. On a single pass through the recycling device including the filter-drier 50, the R22 refrigerant was dried to a moisture content level of 8.9 ppm water. Since ARI Standard 700 specification sets a maximum moisture content level desired to be achieved in R22 refrigerant at 10 ppm water. These test results demonstrate the present invention's capability to meet this specification.

Further testing of the present invention was conducted with another high moisture solubility refrigerant, namely R134*a*, which is used in automobile A/C units. In this case, a dual configuration filter-drier 50 which employed two individual filter-driers 20 each having a body with a length of thirty-six inches (36") and an inner diameter of one inch (1") was tested in a refrigerant recycling device. In this test, 67 pounds of R134*a* at a wet moisture content level of 281 ppm water was dried to a moisture content level of 30 ppm water on a single pass through the recycling device which included the filter-drier 50. Based upon this data, it is believed that the present invention is capable of meeting the SAE Test Specification for R134*a* which requires that the recycle equipment dry 30 pounds of R134*a* having a wet moisture content level of 1300 ppm water to 50 ppm water.

As a comparison to conventional replaceable core filter-driers 10, one pass through a dual configuration filter-drier 50 of the present invention is equivalent to between thirty-eight (38) and forty-eight (48) passes through a replaceable core filter-drier 10; three passes through the present invention 50 is equivalent to between 114 and 146 passes through the filter-driers 10 currently used, and so on. The dehydrating efficiency of the present invention is enormously increased over other filter-drier devices 10 used in recycling equipment.

The present invention achieves the advantage of dramatically improving the efficiency and capacity of a filter-drier for use in a recycling device by substantially increasing the amount and duration of contact between the desiccant and the refrigerant. The increase in efficiency of the filter-drier results in the saving of time, energy and other costs, such as labor, associated with refrigeration system maintenance and repair. In addition, the present invention may be used to purify a variety of high moisture solubility refrigerants, such as R22 or R134*a*, to ARI 700 and SAE Standards, respectively. Further, multiple filter-driers can be connected in series to both increase the dehydration capacity and efficiency of the unit over a single filter-drier of the present invention and allow each filter-drier to be used to maximum capacity while still maintaining a factor of safety. Still other advantages of the present invention are that it is light-weight, it is easy and inexpensive to manufacture, it can be tailored to meet specific dehydration needs, and it can be easily replaced as an entire unit or as a component of a multi-unit configuration.

The present invention has been described in an illustrative manner. It is to be understood that the terminology which has been used is intended to be in the nature of words of description rather than of limitation. Many modifications or variations of the present invention are possible in light of the above teachings. Therefore, within the scope of the appended claims, the present invention may be practiced otherwise than as specifically described.

What is claimed is:

1. A refrigerant filter-drier for use in a refrigerant recycling device comprising:

a long, cylindrical body of a predetermined length ranging from about fifteen inches to about thirty-six inches or more and a predetermined diameter ranging from about one inch to about two inches and having an inlet and an outlet, said body defining a volume and containing a closely packed, beaded desiccant material, said desiccant material occupying substantially the entire said volume of said body.

2. The filter-drier apparatus of claim 1, wherein said predetermined length of said body is twenty-four inches and said predetermined diameter of said body is one inch.

3. The filter-drier apparatus of claim 1, wherein said desiccant material is any combination of desiccants or other adsorbant materials including molecular sieve, activated alumina or activated charcoal.

4. The filter-drier apparatus of claim 1, wherein said desiccant material is molecular sieve.

5. The filter-drier apparatus of claim 1, wherein said outlet comprises an outlet fluid fitting, an outlet filter and an outlet screen located thereon, said outlet screen closing said outlet of said body and preventing said desiccant material from exiting said body;

said inlet comprises an inlet fluid fitting, an inlet filter and a spring member located thereon, said spring member being disposed between said inlet fluid fitting and said inlet filter; and wherein said desiccant material is biasingly retained within said body between said inlet filter and said outlet screen by said spring member.

6. A refrigerant filter-drier for use in a refrigerant recycling device comprising:

a plurality of long, cylindrical bodies each having a predetermined length and a predetermined diameter and including an inlet and an outlet said bodies each defining a volume and each containing a closely packed, beaded desiccant material, said desiccant material occupying substantially the entire said volume of each said body; and wherein said bodies are connected in series and include a moisture indicator located between a first body and a second body.

7. The filter-drier apparatus of claim 6, wherein said predetermined lengths of said bodies range from about fifteen inches to about thirty-six inches or more and said predetermined diameters of said bodies range from about one inch to about two inches.

8. The filter-drier apparatus of claim 6, wherein said predetermined lengths of said bodies are twenty-four inches and said predetermined diameters are one inch.

9. The filter-drier apparatus of claim 6, wherein said desiccant material is any combination of desiccants or other adsorbant materials including molecular sieve, activated alumina or activated charcoal.

10. The filter-drier apparatus of claim 6, wherein said desiccant material is molecular sieve.

11. The filter-drier apparatus of claim 6, wherein said plurality is two.

12. The filter-drier apparatus of claim 6, wherein each said outlet of each said body comprises an outlet fluid fitting, an outlet filter and an outlet screen located thereon, each said outlet screen closing said each outlet of each said body and preventing said desiccant material from exiting each said body;

each said inlet of each said body comprises an inlet fluid fitting, an inlet filter and a spring member located thereon, each said spring member being disposed between each said inlet fluid fitting and each said inlet filter; and wherein said desiccant material is biasingly retained within each said body between each said inlet filter and each said outlet screen by each said spring member.

13. A refrigerant recycling device for recovering and recycling refrigerant in a refrigeration system, said recycling device comprising:

filter-drier means for reducing the moisture content level in said refrigerant; and wherein said filter-drier means comprises a plurality of long, cylindrical bodies each having a predetermined length and a predetermined diameter and including an inlet and an outlet, said bodies each defining a volume and each containing a closely packed, beaded desiccant material, said desiccant material occupying substantially the entire said volume of each said body, said bodies being connected in series and including a moisture indicator located between a first body and a second body.

14. The refrigerant recycling device of claim 13, wherein said predetermined lengths of said bodies range from about fifteen inches to about thirty-six inches or more and said predetermined diameters of said bodies range from about one inch to about two inches.

15. The refrigerant recycling device of claim 13, wherein said predetermined lengths of said bodies are twenty-four inches and said predetermined diameters are one inch.

16. The refrigerant recycling device of claim 13, wherein said desiccant material is any combination of desiccants or other adsorbent materials including molecular sieve, activated alumina or activated charcoal.

17. The refrigerant recycling device of claim 13, wherein said desiccant material is molecular sieve.

18. The refrigerant recycling device of claim 13, wherein said plurality is two.

19. The refrigerant recycling device of claim 13, wherein each said outlet of each said body further comprises an outlet fluid fitting, an outlet filter and an outlet screen located thereon, each said outlet screen closing said each outlet of each said body and preventing said desiccant material from exiting each said body;

each said inlet of each said body further comprises an inlet fluid fitting, an inlet filter and a spring member located therein, each said spring member being disposed between each said inlet fluid fitting and each said inlet filter; and wherein said desiccant material is biasingly retained within each said body between each said inlet filter and each said outlet screen by each said spring member.

* * * * *

UNITED STATES PATENT AND TRADEMARK OFFICE

CERTIFICATE OF CORRECTION

PATENT NO. : 5,240,483

DATED : August 31, 1993

INVENTOR(S) : Shelvin Rosen

It is certified that error appears in the above-indentified patent and that said Letters Patent is hereby corrected as shown below:

Column 2, Line 38,
"o" should be --or--.

Column 3, Line 6,
"refigerant" should be --refrigerant--.

Column 7, Line 32,
"2" should be --28--.

Column 7, Line 45,
"2" should be --20--.

Column 10, Line 39, Claim 6,
after "outlet" insert --,--.

Column 12, Line 23, Claim 19,

"therein" should be --thereon--.

Signed and Sealed this

Twelfth Day of April, 1994

*Attest:*

Bruce Lehman

BRUCE LEHMAN

*Attesting Officer*

*Commissioner of Patents and Trademarks*